US009303604B2

(12) United States Patent
Hackett et al.

(10) Patent No.: US 9,303,604 B2
(45) Date of Patent: Apr. 5, 2016

(54) ASYMMETRICAL ORIFICE FOR BYPASS CONTROL

(71) Applicant: Caterpillar, Inc., Peoria, IL (US)

(72) Inventors: David Elliot Hackett, Washington, IL (US); Scott Shafer, Morton, IL (US); Martin Lehman, Congerville, IL (US); Alan Willard Wells, North Fort Myers, FL (US); Lifeng Wang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 264 days.

(21) Appl. No.: 14/154,946

(22) Filed: Jan. 14, 2014

(65) Prior Publication Data

US 2015/0198124 A1 Jul. 16, 2015

(51) Int. Cl.

| | |
|---|---|
| ***F02M 19/025*** | (2006.01) |
| ***F02M 37/22*** | (2006.01) |
| ***F15D 1/02*** | (2006.01) |
| ***F02M 37/00*** | (2006.01) |

(52) U.S. Cl.

CPC ..... *F02M 37/22* (2013.01); *F02M 19/025* (2013.01); *F02M 37/0052* (2013.01); *F02M 37/0058* (2013.01); *F15D 1/025* (2013.01)

(58) Field of Classification Search

CPC ... F02M 37/22; F02M 19/025; F02M 21/023; F02M 37/0052; F02M 37/0058; F15D 1/003; F15D 1/00; F15D 1/0005; F15D 1/005

See application file for complete search history.

(56) References Cited

U.S. PATENT DOCUMENTS

| | | | | |
|---|---|---|---|---|
| 3,970,104 | A | 7/1976 | Decker et al. | |
| 4,053,410 | A | 10/1977 | Lorimor | |
| 4,066,386 | A | 1/1978 | Johnson et al. | |
| 4,539,809 | A | 9/1985 | Stanley et al. | |
| 4,877,377 | A | 10/1989 | Taylor | |
| 4,932,205 | A | 6/1990 | Alderfer et al. | |
| 5,148,792 | A * | 9/1992 | Tuckey | F02D 33/006 123/497 |
| 2003/0052051 | A1 | 3/2003 | Nam et al. | |

FOREIGN PATENT DOCUMENTS

| | | |
|---|---|---|
| DE | 2049172 | 4/1972 |

* cited by examiner

*Primary Examiner* — Lindsay Low
*Assistant Examiner* — Jacob Amick
(74) *Attorney, Agent, or Firm* — Miller, Matthias & Hull LLP

(57) ABSTRACT

An asymmetrical orifice for bypass control in a clean fuel module may include a body having first and second end surfaces and an inner surface defining a bore through the body extending from a first opening through the first end surface to a second opening through the second end surface. The first opening has a first opening inner diameter and the second opening has a second opening inner diameter that is less than the first opening inner diameter. The asymmetrical orifice also includes a flow control contour in the second end surface surrounding the second opening of the bore. The configuration may give the asymmetrical orifice a first discharge coefficient for fluid flowing from the first opening to the second opening that is greater than a second discharge coefficient for fluid flowing in a second direction from the second opening to the first opening.

20 Claims, 4 Drawing Sheets

ASYMMETRICAL ORIFICE FOR BYPASS CONTROL

TECHNICAL FIELD

This disclosure relates generally to fuel control systems and, in particular, to an asymmetrical orifice for bypass control in a clean fuel module.

BACKGROUND

In machines powered by internal combustion engines, fuel is supplied to the engine by a fuel transfer pump (FTP). The fuel for the engine, such as gasoline and diesel fuel, contains impurities that can cause build up of material in the fuel system components that ultimately requires maintenance to clean the components of the fuel system. Consequently, fuel is typically passed through a fuel filter before being communicated to the fuel transfer pump to remove the impurities and forestall the need for maintenance to the fuel system.

Because fuel in the tank or reservoir of the machine is not pressurized, low pressure at the inlet of the fuel transfer pump draws fuel from the reservoir through the fuel filter and into the fuel transfer pump for transmission to the engine. The fuel system works initially, but the filtered material builds up in the fuel filter and increases the pressure drop across the fuel filter necessary to draw fuel through filter. Eventually, the low pressure at the inlet of the fuel transfer pump is insufficient to draw fuel through the fuel filter and the engine cannot execute the combustion cycle. Fuel flow is improved in some know fuel systems by providing a clean fuel module (CFM) that filters the fuel while also providing a pressure boost to the fuel communicated the fuel transfer pump to improve the performance of the fuel transfer pump.

In one known configuration, a clean fuel module has a return manifold with a fuel inlet port connected to the fuel reservoir of the machine, a fuel outlet port connected to the fuel transfer pump, and a flow channel between the fuel inlet port and the fuel outlet port putting the inlet and outlet ports in fluid communication. The clean fuel module also includes a bypass or kidney loop where the fuel is filtered before transmission to the fuel transfer pump. To recirculate fuel through the bypass loop, the return manifold further includes a bypass outlet port proximate the fuel inlet port and a bypass inlet port proximate the fuel outlet port. The bypass outlet port is connected to an inlet of a CFM pump, an outlet of the CFM pump is connected to an inlet of a fuel filter, and an outlet of the fuel filter is connected to the bypass inlet port of the return manifold. The CFM pump increase the pressure of the fuel to force it through the fuel filter, and to provide the fuel to the inlet of the fuel transfer pump with a pressure boost that improves the performance of the fuel transfer pump.

Within the return manifold, a check valve is disposed within the flow channel to separate the fuel inlet port and the bypass outlet port from the fuel outlet port and the bypass inlet port. The check valve allows some flow of the pressurized fuel being communicated to the fuel transfer pump to the low pressure side of the check valve at the fuel inlet port, but the check valve closes to prevent fluid flow in the reverse direction from the fuel inlet port to the fuel outlet port. During normal operation, fuel bypasses the flow channel as the CFM pump discharges fuel from the fuel reservoir through the fuel filter and to the fuel transfer pump. The check valve creates a restriction between the fuel outlet port and the low pressure fuel inlet port to boost the pressure of the fluid transmitted to the fuel transfer pump while allowing some fuel flow through the check valve to prevent the outlet pressure from exceeding a maximum boost pressure. If the CFM pump stops working, the pressure at the fuel outlet port decreases and the check valve closes to prevent unfiltered fluid from flowing through the flow channel. At the same time, some bypass flow through the CFM pump and the fuel filter may be maintained as the low pressure at the fuel transfer pump continues to draw fuel.

The addition of the CFM pump increases the loading capacity of the fuel filter which, correspondingly, increases the pressure drop across the fuel filter. The fuel filters can be loaded with filtered material by the CFM pump to present a sufficiently high pressure drop across the fuel filter that the lower pressure created at the inlet of the fuel transfer pump is insufficient to draw fuel through the fuel filter on its own. With no flow through the fuel filter, and with the check valve closed, the engine is deprived of fuel, resulting in a "dead on haul road" condition where the engine stalls, thereby requiring the fuel filter to be serviced on location before moving the machine from the worksite.

In view of this, a need exists for an improved clean fuel module wherein a level of fuel flow is maintained during a CFM pump shutdown to maintain operation of the machine until the machine can be moved to an appropriate location for maintenance.

SUMMARY OF THE DISCLOSURE

In one aspect of the present disclosure, an asymmetrical orifice for bypass control in a clean fuel module is disclosed. The asymmetrical orifice may include a body having a first end surface and a second end surface, an inner surface defining a bore through the body extending from a first opening through the first end surface to a second opening through the second end surface, wherein the first opening has a first opening inner diameter and the second opening has a second opening inner diameter that is less than the first opening inner diameter, and a flow control contour in the second end surface surrounding the second opening of the bore.

In another aspect of the present disclosure, a clean fuel module (CFM) for providing fuel from a fuel reservoir to a fuel transfer pump in a machine having an internal combustion engine is disclosed. The clean fuel module may include a CFM bypass pump having a bypass pump inlet and a bypass pump outlet, a fuel filter having a filter inlet fluidly connected to the bypass pump outlet, and a filter outlet, a return manifold having a fuel inlet port fluidly connected to the fuel reservoir, a fuel outlet port fluidly connected to a fuel inlet of the fuel transfer pump, a flow channel placing the fuel inlet port in fluid communication with the fuel outlet port, a bypass outlet port proximate the fuel inlet port and fluidly connected to the bypass pump inlet, and a bypass inlet port proximate the fuel outlet port and fluidly connected to the fuel transfer pump, and an asymmetrical orifice disposed within the flow channel of the return manifold and separating the fuel inlet port and the bypass outlet port from the fuel outlet port and the bypass inlet port. The asymmetrical orifice may include a body having a first end surface and a second end surface, an inner surface defining a bore through the body extending from a first opening through the first end surface to a second opening through the second end surface, wherein the first opening has a first opening inner diameter and the second opening has a second opening inner diameter that is less than the first opening inner diameter, and a flow control contour in the second end surface surrounding the second opening of the bore. The body of the asymmetrical orifice may engage the flow channel so that the fuel flows through the bore to place the fuel inlet port in fluid communication with the fuel outlet port.

Additional aspects are defined by the claims of this patent.

DETAILED DESCRIPTION

Although the following text sets forth a detailed description of numerous different embodiments of the present disclosure, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112(f).

Figure 1:
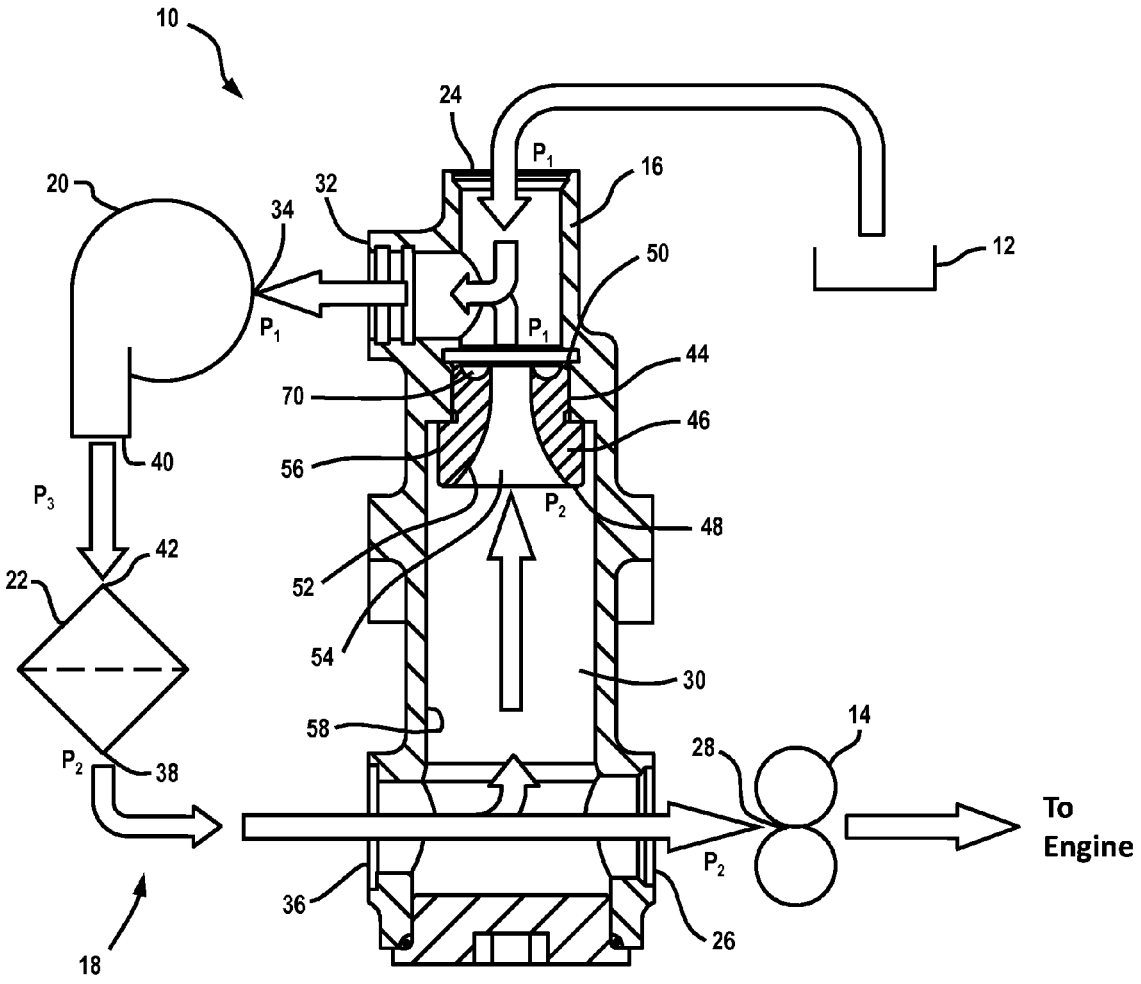
FIG. 1 is a partial cross-sectional, partial schematic view of an embodiment of a clean fuel module in accordance with the present disclosure with a clean fuel module pump operating to provide pressurized fuel to a fuel transfer pump.

FIG. 1 illustrates an exemplary clean fuel module 10 for a machine that operates under the power provided by an internal combustion engine (not shown) executing a combustion cycle using a combustible fuel, such as gasoline or diesel fuel, from a fuel reservoir 12 of the machine. The fuel from the fuel reservoir 12 passes through the clean fuel module 10 and on to a fuel transfer pump 14 that communicates the fuel to the engine. The clean fuel module 10 may function to filter impurities from the fuel to provide clean fuel to the fuel transfer pump 14 and reduce the buildup of material in the engine and other components of the fuel system (not shown).

Fuel filtration in the clean fuel module is achieved by providing a return manifold 16 fluidly connecting the fuel reservoir 12 to the fuel transfer pump 14, and a fuel filtering bypass or kidney loop 18 formed by a CFM pump 20 and at least one fuel filter 22 creating an alternate route for the fuel flowing from the fuel reservoir 12 to the fuel transfer pump 14. The return manifold 16 may include a fuel inlet port 24 fluidly connected to the fuel reservoir 12, a fuel outlet port 26 fluidly connected to an FTP inlet port 28 of the fuel transfer pump 14, and a flow channel 30 placing the fuel inlet port 24 in fluid communication with the fuel outlet port 26. The return manifold 16 may further include a bypass outlet port 32 positioned proximate the fuel inlet port 24 and fluidly connected to a bypass pump inlet port 34 of the CFM pump 20, and a bypass inlet port 36 disposed proximate the fuel outlet port 26 and fluidly connected to a filter outlet port 38 of the fuel filter 22. To complete the fuel filtering bypass loop 18, a bypass pump outlet port 40 of the CFM pump 20 may be fluidly connected to a filter inlet port 42 of the fuel filter 22.

To control the flow of fuel through the flow channel 30 and around the flow channel 30 through the fuel filtering bypass loop 18, an asymmetrical orifice 44 may be disposed within the flow channel 30 of the return manifold 16 in a position that separates the fuel inlet port 24 and the bypass outlet port 32 from the fuel outlet port 26 and the bypass inlet port 36. The asymmetrical orifice 44 may have a body 46 having a first end surface 48 and a second end surface 50, and an inner surface 52 defining a bore 54 through the body 46 extending from the first end surface 48 to the second end surface 50. An outer surface 56 of the body 46 of the asymmetrical orifice 44 and an inner surface 58 of the return manifold 16 defining the flow channel 30 may be configured with complimentary shapes so that the outer surface 56 engages the inner surface 58 defining the flow channel 30 to form a fluid-tight seal there between so that fuel flows through the bore 54 to place the fuel inlet port 24 in fluid communication with the fuel outlet port 26 without fuel leaking through the interface between the outer surface 56 of the asymmetrical orifice 44 and the inner surface 58 of the return manifold 16. If necessary, an additional sealing device such as a gasket or O-ring seal may be disposed between the engaging surfaces 56, 58 to further ensure that the fuel passes through the bore 54.

Figure 2:
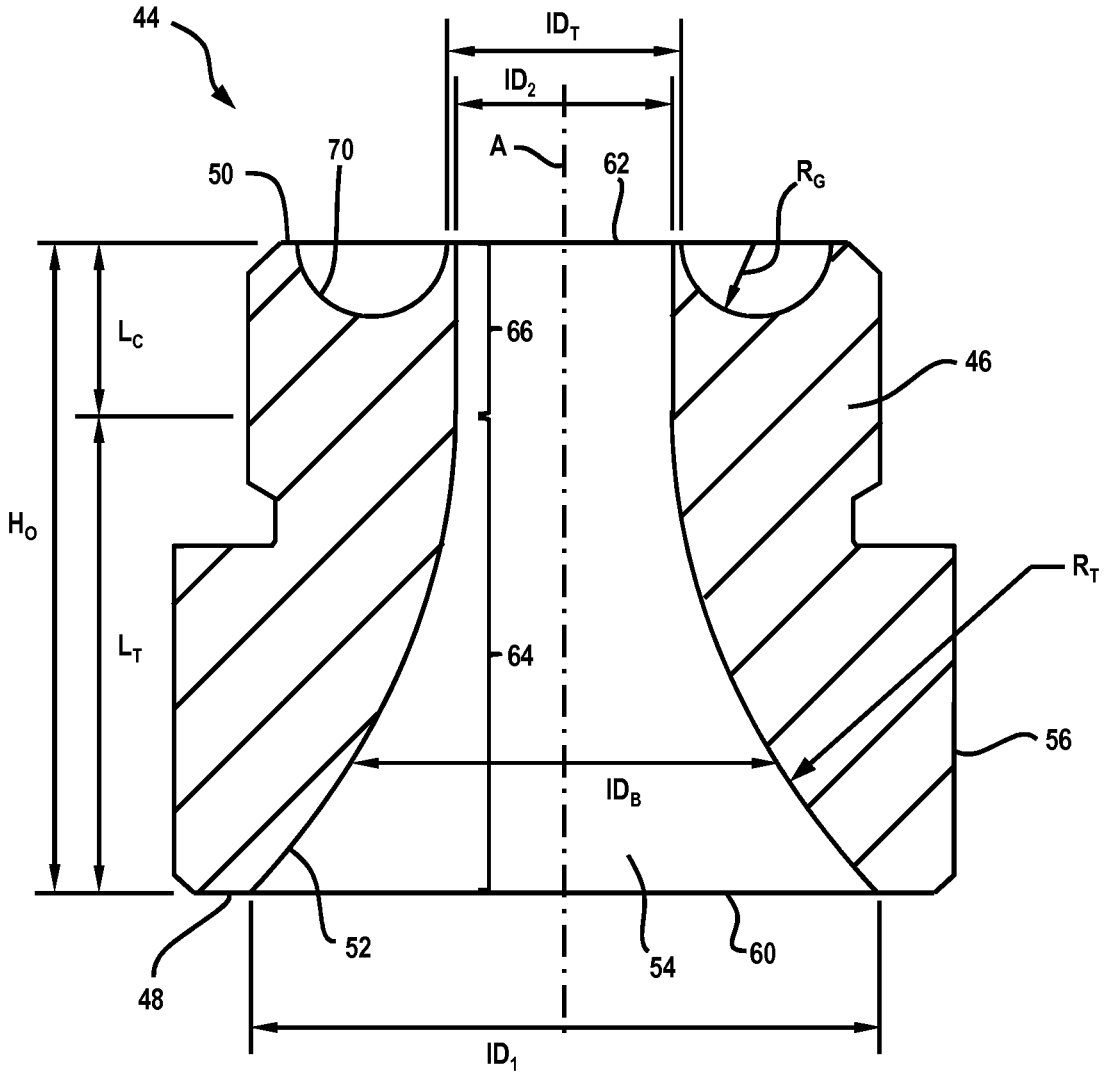
FIG. 2 is an enlarged cross-sectional view of an asymmetrical orifice of the clean fuel module of FIG. 1.

The asymmetrical orifice 44 is shown in greater detail in FIG. 2. In the illustrated embodiment, the body 46 of the asymmetrical orifice 44 may be symmetrical about a longitudinal axis A and have a longitudinal orifice height $H_O$, with the bore 54 also being centered about the longitudinal axis A. However, depending on the particular implementation, the body 46 may not be symmetrical about an axis and/or the bore 54 may not necessarily be centered about the longitudinal axis A of the body 46. As shown, the bore 54 of the asymmetrical orifice 44 may have a first opening 60 through the first end surface 48 having a first opening inner diameter $ID_1$. At the opposite end of the asymmetrical orifice 44, the bore 54 may have a second opening 62 through the second end surface 50 having a second opening inner diameter $ID_2$. The bore 54 may have a bore inner diameter $ID_B$ that varies as the inner surface 52 extends from the first end surface 48 to the second end surface 50 to create the necessary fluid flow characteristics for the clean fuel module 10.

For purposes of the discussion of the asymmetrical orifice 44, a normal flow direction refers to fluid flow through the bore 54 from the first opening 60 to the second opening 62, or from the fuel outlet port 26 to the fuel inlet port 24, and a reverse flow direction refers to fluid flow through the bore 54 in the opposite direction. In the present embodiment, the first opening inner diameter $ID_1$ is greater than the second opening inner diameter $ID_2$. The bore inner diameter $ID_B$ may have a maximum value equal to the first opening inner diameter $ID_1$ at the first opening 60 and a minimum value equal to the second opening inner diameter $ID_2$ at the second opening 62. Between the openings 60, 62, the inner surface 52 may taper inwardly as the inner surface 52 extends from the first end surface 48 to define a Venturi shape for at least a portion of the bore 54. In other words, the bore inner diameter $ID_B$ may decrease from a value equal to the first opening inner diameter $ID_1$ at the first opening 60 as the bore 54 extends inwardly into the body 46 toward the second opening 62, and the rate of decrease of the bore inner diameter $ID_B$ may be greatest at the first opening 60 and decrease as the bore 54 extends toward the second end surface 50. The desired rate of decrease of the bore inner diameter $ID_B$ may be achieved by having the inner surface 52 follow a circular arc having a taper radius $R_T$, though the precise geometry may vary.

In some embodiments, the bore 54 may continue to taper inwardly until the bore inner diameter $ID_B$ is equal to the second inner diameter $ID_2$ at the second opening 62. In such configurations, the second opening 62 may nearly approximate a square edged orifice for fuel flowing in the reverse flow direction in terms of the fluid flow characteristics of the second opening 62. In the present embodiment, the second opening 62 is presented as a square edged orifice by configuring the inner surface 52 to form the bore 54 with a bore tapered portion 64 beginning at the first opening 60 and extending toward the second opening 62 for a prescribed taper length $L_T$, and a bore cylindrical portion 66 beginning at the second opening 62 and extending toward the first opening 60 for a prescribed cylinder length $L_C$. The bore tapered portion 64 may taper with a Venturi shape as described above until the bore inner diameter $ID_B$ is equal to the second opening inner diameter $ID_2$ before reaching the second opening 62 at the taper length $L_T$. The bore cylindrical portion 66 of the bore 54 may extend from the second opening 62 toward the first opening 60 with the bore inner diameter $ID_B$ having a constant diameter equal to the second opening inner diameter $ID_2$ for the cylinder length $L_C$ at which the bore cylindrical portion 66 intersects the bore tapered portion 64.

With the asymmetrical tapered configuration of the bore 54 as illustrated and described herein, those skilled in the art will understand that the asymmetrical orifice 44 maximizes fluid flow in the normal flow direction, while restricting but not preventing fluid flow in the reverse flow direction. For flow in the normal flow direction, the Venturi-shaped profile presents a relatively high discharge coefficient that may be within the range 0.85 to 1.00, and may have a discharge coefficient value that is approximately 0.95. In the reverse flow direction, the square edged or approximately square edged orifice at the second opening 62 is more resistant to fluid flow there through, and may have a discharge coefficient that is less than 0.75, and may be at least as low as 0.62 for fluid flows having Reynolds numbers on the order of $10^4$ or greater. The significance of these flow characteristics of the asymmetrical orifice 44 will be discussed in greater detail below.

To further restrict fluid flow in the reverse flow direction, the second end surface 50 of the asymmetrical orifice 44 may be configured to create turbulence or counter flow at the second opening 62 acting against the flow entering the second opening 62 of the bore 54. Such turbulence and counter flow may be created by providing contours in the second end surface 50 around the second opening 62 that can disturb and redirect fluid in a manner that affects the fluid flowing into the second opening 62. In the illustrated embodiment, a toroidal groove 70 is formed in the second end surface 50 and encircles the second opening 62. The toroidal groove 70 may be centered along with the bore 54 about the longitudinal axis A and have a toroidal inner diameter $ID_T$ that is greater than the second inner diameter $ID_2$. The toroidal groove 70 may have a semi-circular cross-section as shown with a groove diameter $R_G$. The toroidal inner diameter $ID_T$ and the groove radius $R_G$ may be varied as necessary to create the desired level of turbulence and/or counter flow against fluid flow in the reverse flow direction.

Figure 3:
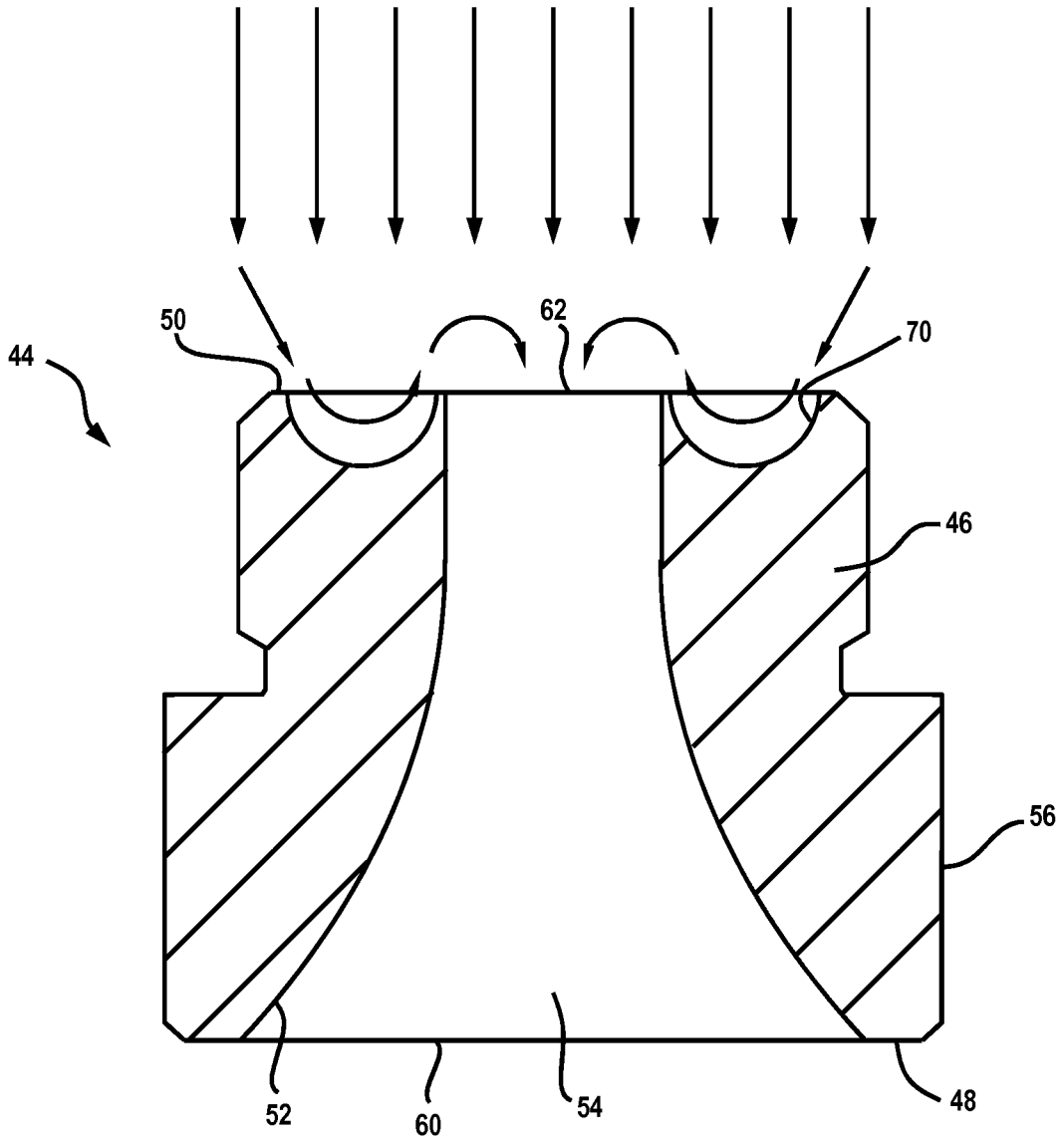
FIG. 3 is an enlarged cross-sectional view of the asymmetrical orifice of FIG. 2 illustrating flow patterns in a reverse flow direction.

FIG. 3 illustrates exemplary flow characteristics in the reverse flow direction at the second end surface 50 of the asymmetrical orifice 44 that may be created by the toroidal groove 70. A portion of the fuel flowing toward the asymmetrical orifice 44 flows into the toroidal groove 70 and is redirected toward the second opening 62. The fuel exiting the toroidal groove 70 may cause turbulence at the second opening 62, or backflow or counter flow across the second opening 62 or away from the second end surface 50. The turbulence and flow from the toroidal groove 70 cause a flow disturbance at the second opening 62 to further reduce the discharge coefficient in the reverse flow direction.

In one exemplary embodiment, the asymmetrical orifice 44 may have the approximate dimension set forth in Table 1 as follows:

TABLE 1

| | |
|---|---|
| Orifice height $H_O$ | 37.5 mm (1.476 inches) |
| Taper length $L_T$ | 28.4 mm (1.118 inches) |
| Cylinder length $L_C$ | 9.1 mm (0.3583 inch) |
| Taper radius $R_T$ | 40.0 mm (1.575 inches) |
| First opening inner diameter $ID_1$ | 36.0 mm (1.417 inches) |
| Second opening inner diameter $ID_2$ | 12.5 mm (0.4921 inch) |
| Toroid inner diameter $ID_T$ | 13.5 mm (0.5315 inch) |
| Groove radius $R_G$ | 4.4 mm (0.1732 inch) |

The exemplary asymmetrical orifice 44 maximizes flow in the normal flow direction and restricts flow in the reverse flow direction. The discharge coefficient in the normal direction may be approximately 0.95, and the discharge coefficient may be less than approximately 0.55 in the reverse direction, which is a further restriction over the asymmetrical orifice 44 without the toroidal groove 70 or other flow control contours in the second end surface 50.

The toroidal groove 70 illustrated and described herein is one example of a contour in the second end surface 50, and other contours are contemplated as having use in further restricting fluid flow in the reverse direction through the second opening 62. For example, the toroidal groove 70 may have alternative cross-sections to the semicircular cross-section illustrated herein. In alternative embodiments, the toroidal groove may have noncircular curved cross-sections, square or rectangular cross-sections, triangular cross-sections or other more complex cross-sectional geometries. In other alternative embodiments, the single continuous toroidal groove 70 may be replaced by two or more individual indentations, recesses or other types of contours in the second end surface 50 circumferentially spaced about the second opening 62. These and other alternative contour configurations for the second end surface 50 that decrease the discharge coefficient in the reverse flow direction are contemplated by the inventors as having use in asymmetrical orifices 44 in accordance with the present disclosure.

INDUSTRIAL APPLICABILITY

Returning to FIG. 1, the operation of the clean fuel module 10 under normal operating conditions will be described. In the following discussion, a first pressure $P_1$ represents the pressure of the fuel from the fuel reservoir 12 at the fuel inlet port 24 and the bypass outlet port 32, a second pressure $P_2$ represents the pressure of the fuel flowing to the FTP inlet port 28 through the bypass inlet port 36 and the fuel outlet port 26, and a third pressure $P_3$ represents the pressure at the bypass pump outlet port 40. The fuel reservoir 12 is typically not pressurized, so the first pressure $P_1$ may be approximately equal to an atmospheric pressure in the environment in which the machine is operating. Fuel having the first pressure $P_1$ enters the operating CFM pump 20 at the bypass pump inlet port 34, and is discharged from the bypass pump outlet port 40 at the third pressure $P_3$, which is greater than the first pressure $P_1$. The fuel discharged from the CFM pump 20 passes through the fuel filter 22 where impurities are filtered out of the fuel and the fuel experiences a pressure drop to the second pressure $P_2$, which is necessarily less than the third pressure $P_3$. The second pressure $P_2$ will have a maximum value that is greater than the first pressure $P_1$ when a new fuel filter 22 is installed, and will gradually decrease toward the first pressure $P_1$ as filtered material collects in the fuel filter 22 and the pressure drop through the fuel filter 22 increases. The fuel at the second pressure $P_2$ passes through the bypass inlet port 36 of the return manifold 16, and is divided between the fuel outlet port 26 and ultimately the fuel transfer pump 14, and the flow channel 30.

At the same time fuel flows through the bypass loop 18, the difference between the first pressure $P_1$ and the second pressure $P_2$ causes flow of fuel through the asymmetrical orifice 44 in the normal flow direction. Because the bore tapered portion 64 has a high discharge coefficient, fuel may flow through the bore 54 at close to the expected flow rate. To preserve the flow characteristics of the previously known return manifolds having check valves, the bore 54 may be sized to match the forward flow restriction of the check valve. Consequently, the second pressure $P_2$ is maintained at less than or equal to a maximum fuel outlet pressure by allowing the fuel to flow through the asymmetrical orifice 44, thereby providing a pressure boost to the fuel transfer pump 14 to improve the performance of the fuel system. The fuel flowing through the asymmetrical orifice 44 is recirculated through the bypass loop 18.

The clean fuel module 10 continues to operate as described with normal flow through the asymmetrical orifice 44 as long as the CFM pump 20 is operating and the fuel filter 22 is clean enough so that the second pressure $P_2$ is greater than the first pressure $P_1$. However, if the CFM pump 20 ceases operating, such as when an electrical failure occurs, the fuel is not pressurized by the CFM pump 20, and instead any fuel flowing through the CFM pump 20 experiences a pressure drop so that the third pressure $P_3$ is less than the first pressure $P_1$. A further pressure drop occurs is fuel passes through the fuel filter 22 so that the second pressure $P_2$ is less than both the third pressure $P_3$ and the first pressure $P_1$. Such flow occurs as the fuel transfer pump 14 continues attempting to draw fuel from the clean fuel module 10, thereby lowering the second pressure $P_2$.

Figure 4:
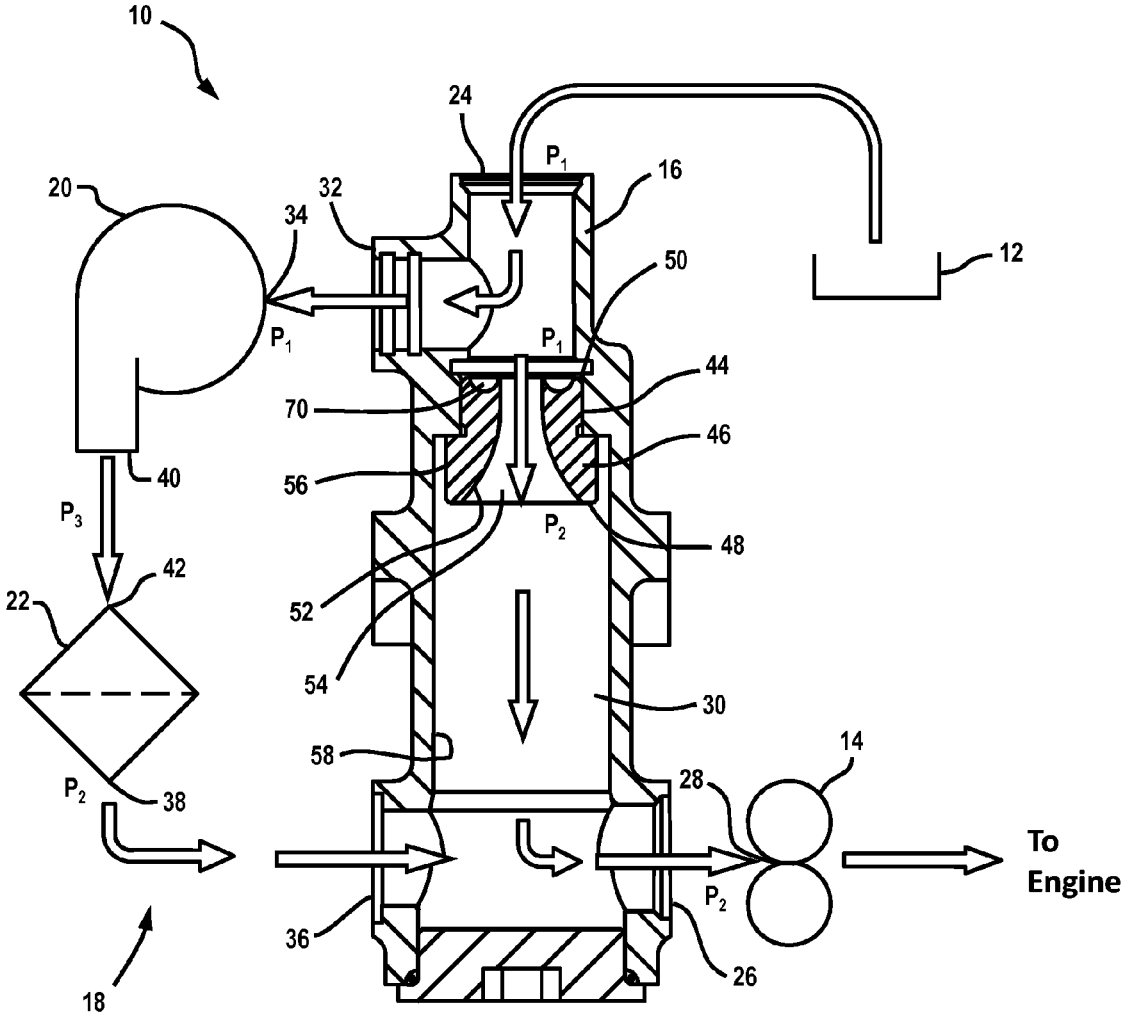
FIG. 4 is a partial cross-sectional, partial schematic view of the clean fuel module of FIG. 1 with the clean fuel module pump inoperative and not providing pressurized fuel to the fuel transfer pump.

Referring to FIG. 4, fluid flow after failure of the CFM pump 20 is illustrated. Fuel flows through the bypass loop 18 due to the low second pressure $P_2$. At the same time, within the flow channel 30 of the return manifold 16, fuel flows in the reverse flow direction through the asymmetrical orifice 44 due to the pressure drop from the first pressure $P_1$ to the second pressure $P_2$. The reverse flow occurs in contrast to previous return manifolds where the check valve would close to prevent reverse flow. Due to the low discharge coefficient in the reverse flow direction, the fuel flow is restricted but occurs so that the flow through the asymmetrical orifice 44 combined with the fuel flow through the bypass loop 18 allows the engine to perform the combustion cycle until the machine can be moved to an appropriate location for maintenance. Fuel can continue flowing to the fuel transfer pump 14 even after material builds up in the fuel filter 22 sufficiently that the pressure drop prevents the fuel transfer pump 14 from drawing fuel through the fuel filter 22 when the CFM pump 20 is not operating, or prevents the CFM pump 20 from forcing fuel through the fuel filter 22 when the CFM pump 20 is operational.

The asymmetrical orifice 44 in accordance with the present disclosure allows for extended operation of the clean fuel module 10 and, correspondingly, the fuel system, during a failure of the CFM pump 20 or a fouling of the fuel filter 22 severely restricting or preventing flow through the bypass loop 18. Previously, such conditions ultimately resulted in stalling of the engine. The extended operation allows the machine to be moved to an appropriate service location instead of requiring maintenance at a jobsite and potentially obstructing replacement equipment from completing the task of the machine. Moreover, replacement of the check valve and its moving components with the asymmetrical orifice 44 eliminates a potential failure mode within the return manifold 16, thereby further preventing unnecessary and inconvenient maintenance requirements.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. An asymmetrical orifice for bypass control in a clean fuel module, comprising:

a body having a first end surface and a second end surface;

an inner surface defining a bore through the body extending from a first opening through the first end surface to a second opening through the second end surface, wherein the first opening has a first opening inner diameter and the second opening has a second opening inner diameter that is less than the first opening inner diameter; and a flow control contour in the second end surface surrounding the second opening of the bore, wherein the flow control contour is a recess formed into the body.

2. The asymmetrical orifice of claim 1, wherein the bore has a bore longitudinal axis and the flow control contour is centered along the bore longitudinal axis.

3. The asymmetrical orifice of claim 2, wherein the body has a body longitudinal axis that is coincident with the bore longitudinal axis.

4. The asymmetrical orifice of claim 1, wherein the flow control contour comprises a toroidal groove in the second end surface encircling the second opening of the bore.

5. The asymmetrical orifice of claim 4, wherein the toroidal groove has a semi-circular cross-section.

6. The asymmetrical orifice of claim 1, wherein the asymmetrical orifice has a first discharge coefficient equal to approximately 0.95 for fluid flowing in a first direction from the first opening to the second opening.

7. The asymmetrical orifice of claim 6, wherein the asymmetrical orifice has a second discharge coefficient less than approximately 0.55 for fluid flowing in a second direction from the second opening to the first opening.

8. The asymmetrical orifice of claim 1, wherein the bore has a bore inner diameter that decreases from a value equal to the first opening inner diameter at the first opening as the bore extends inwardly into the body from the first end surface toward the second end surface.

9. The asymmetrical orifice of claim 8, wherein the bore comprises a bore tapered portion beginning at the first end surface and extending inwardly into the body toward the second end surface, wherein a rate of decrease of the bore inner diameter is greatest at the first opening and decreases as the bore extends inwardly into the body toward the second end surface.

10. The asymmetrical orifice of claim 9, wherein the bore comprises a bore cylindrical portion beginning at the second end surface and extending inwardly into the body toward the first end surface with the bore inner diameter remaining equal to the second opening inner diameter until the bore cylindrical portion intersects the bore tapered portion.

11. A clean fuel module (CFM) for providing fuel from a fuel reservoir to a fuel transfer pump in a machine having an internal combustion engine, the clean fuel module comprising:

a CFM bypass pump having a bypass pump inlet and a bypass pump outlet;

a fuel filter having a filter inlet fluidly connected to the bypass pump outlet, and a filter outlet;

a return manifold having a fuel inlet port fluidly connected to the fuel reservoir, a fuel outlet port fluidly connected to a fuel inlet of the fuel transfer pump, a flow channel placing the fuel inlet port in fluid communication with the fuel outlet port, a bypass outlet port proximate the fuel inlet port and fluidly connected to the bypass pump inlet, and a bypass inlet port proximate the fuel outlet port and fluidly connected to the fuel transfer pump; and an asymmetrical orifice disposed within the flow channel of the return manifold and separating the fuel inlet port and the bypass outlet port from the fuel outlet port and the bypass inlet port, the asymmetrical orifice comprising:

a body having a first end surface and a second end surface, an inner surface defining a bore through the body extending from a first opening through the first end surface to a second opening through the second end surface, wherein the first opening has a first opening inner diameter and the second opening has a second opening inner diameter that is less than the first opening inner diameter, and a flow control contour in the second end surface surrounding the second opening of the bore, wherein the flow control contour is a recess formed into the body, wherein the body of the asymmetrical orifice engages the flow channel so that the fuel flows through the bore to place the fuel inlet port in fluid communication with the fuel outlet port.

12. The clean fuel module claim 11, wherein the bore of the asymmetrical orifice has a bore longitudinal axis and the flow control contour is centered along the bore longitudinal axis.

13. The clean fuel module of claim 12, wherein the body of the asymmetrical orifice has a body longitudinal axis that is coincident with the bore longitudinal axis.

14. The clean fuel module of claim 11, wherein the flow control contour comprises a toroidal groove in the second end surface encircling the second opening of the bore.

15. The clean fuel module of claim 14, wherein the toroidal groove of the asymmetrical orifice has a semi-circular cross-section.

16. The clean fuel module of claim 11, wherein the asymmetrical orifice has a first discharge coefficient equal to approximately 0.95 for fluid flowing in a first direction from the fuel outlet port to the fuel inlet port.

17. The clean fuel module of claim 16, wherein the asymmetrical orifice has a second discharge coefficient less than approximately 0.55 for fluid flowing in a second direction from the fuel inlet port to the fuel outlet port.

18. The clean fuel module of claim 11, wherein the bore of the asymmetrical orifice has a bore inner diameter that decreases from a value equal to the first opening inner diameter at the first opening as the bore extends inwardly into the body from the first end surface toward the second end surface.

19. The clean fuel module of claim 18, wherein the bore of the asymmetrical orifice comprises a bore tapered portion beginning at the first end surface and extending inwardly into the body toward the second end surface, wherein a rate of decrease of the bore inner diameter is greatest at the first opening and decreases as the bore extends inwardly into the body toward the second end surface.

20. The clean fuel module of claim 19, wherein the bore of the asymmetrical orifice comprises a bore cylindrical portion beginning at the second end surface and extending inwardly into the body toward the first end surface with the bore inner diameter remaining equal to the second opening inner diameter until the bore cylindrical portion intersects the bore tapered portion.

* * * * *